US005396533A

United States Patent [19]

Holzermer

[11] Patent Number: 5,396,533

[45] Date of Patent: Mar. 7, 1995

[54] PRIMARY RADIATION DIAPHRAGM FOR A RADIATION APPARATUS

[75] Inventor: Guenter Holzermer, Erlangen, Germany

[73] Assignee: Siemens Aktiengesellschaft, Munich, Germany

[21] Appl. No.: 113,257

[22] Filed: Aug. 30, 1993

[30] Foreign Application Priority Data

Sep. 2, 1992 [DE] Germany ..... 42 29 321.9

[51] Int. Cl.[6] ..... G21K 1/04

[52] U.S. Cl. ..... 378/150; 378/147; 378/152

[58] Field of Search ..... 378/145, 147, 150, 151, 378/152, 153

[56] References Cited

U.S. PATENT DOCUMENTS

| | | | |
|---|---|---|---|
| 2,474,422 | 6/1949 | Hollstein | 378/152 X |
| 3,976,887 | 8/1976 | Holzermer et al. | 378/151 X |
| 4,534,052 | 8/1985 | Milcamps . | |
| 4,691,335 | 9/1987 | Telorack . | |
| 5,161,176 | 11/1992 | Ebinuma et al. | 378/152 X |
| 5,204,892 | 4/1993 | Warden | 378/150 X |

FOREIGN PATENT DOCUMENTS

| | | |
|---|---|---|
| OS 1441312 | 10/1968 | Germany . |
| AS 2024796 | 10/1973 | Germany . |
| GM 8436281 | 5/1986 | Germany . |
| 1258028 | 12/1971 | United Kingdom . |

*Primary Examiner*—David P. Porta
*Attorney, Agent, or Firm*—Hill, Steadman & Simpson

[57] ABSTRACT

A primary radiation diaphragm for a radiation apparatus has at least one diaphragm plate which is adjusted in a plane extending perpendicular relative to the central ray of radiation. Each plate is provided with a single mount which engages a guideway disposed on the wall of the housing. Preferably, four plates are arranged in two pairs, with the first pair lying in a first plane and the second pair lying in a second plane extending parallel to the first pair, each of the plates of the pair has a single mount and the pair of plates of the first pair engage the same guideway, while the pair of the second plate engage a second guideway disposed on a wall of the housing extending at right angles to the first-mentioned wall.

9 Claims, 2 Drawing Sheets

PRIMARY RADIATION DIAPHRAGM FOR A RADIATION APPARATUS

BACKGROUND OF THE INVENTION

The present invention is directed to a primary radiation diaphragm for a radiation apparatus. The diaphragm comprises at least one diaphragm plate adjustable in a plane perpendicular relative to the axis of the central ray of the radiation transmitter or emitter.

U.S. Pat. No. 4,691,335, whose disclosure is incorporated herein by reference thereto and which claims priority from German Application 84 36 281(U), as well as German Published Application 14 41 312, disclose primary radiation diaphragms wherein two diaphragm plate pairs are respectively oppositely adjustable relative to one another in two parallel planes so that a rectangular gating of the x-ray beam is possible. The adjustment of the diaphragm plates lying above one another must, therefore, occur in such a way that only the opening that defines the radiation field is left free. The diaphragm plates are adjustably seated by, respectively, two mounts provided on sides lying opposite one another.

SUMMARY OF THE INVENTION

An object of the present invention is to provide a primary radiation diaphragm having adjustable diaphragm plates which is smaller, assembly-friendlier, more surveyable and has a less complicated structure.

This object is inventively achieved in that a single mount is provided for the diaphragm plate and this mount engages the diaphragm plate and is adjustable along a guideway.

An advantage of the invention is that the second mount of the diaphragm plate can, thus, be eliminated so that the requirements of the stated object are satisfied.

When the ray beam of the radiation transmitter is to be gated slot-shaped, then it is advantageous when two diaphragm plates are arranged parallel to one another in the plane and are oppositely adjustable relative to one another.

It is advantageous for precise guidance of the diaphragm plates when the guideway comprises two guide rails that are mounted on the same side of the housing of the primary radiation diaphragm and when the mount of each diaphragm plate respectively engages on the first and second guide rails via guide parts.

When the radiation field is so gated quadratically or rectangularly, then it is advantageous when two additional diaphragm plates are provided in a plane parallel to the first diaphragm plates and offset by 90° relative to the first diaphragm plates. These two additional diaphragm plates are also oppositely adjusted to one another.

Other advantages and features of the invention will be readily apparent from the following description of the preferred embodiments, the drawings and claims.

DESCRIPTION OF THE PREFERRED EMBODIMENTS

Figure 1:
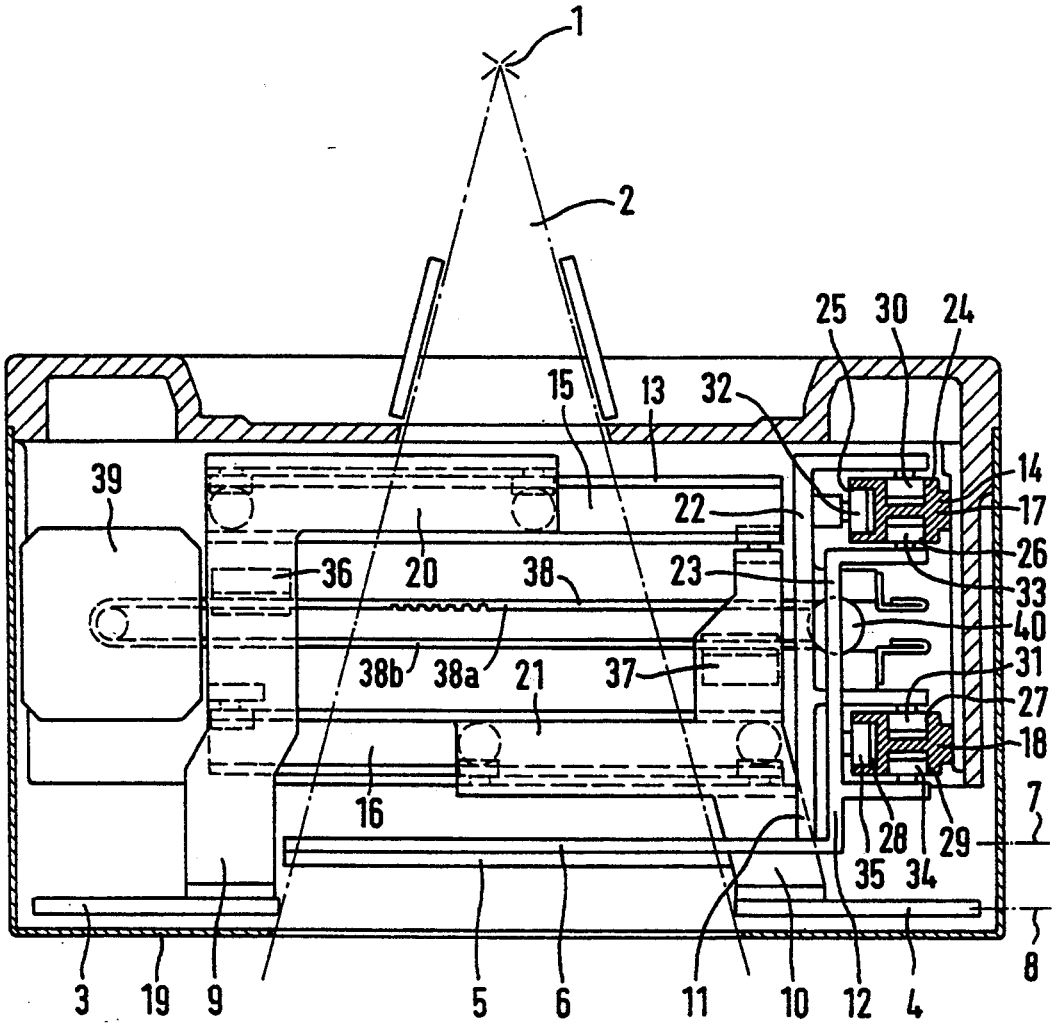
FIG. 1 is a partial cross sectional view with portions in elevation of a primary radiation diaphragm in accordance with the present invention.
Figure 2:
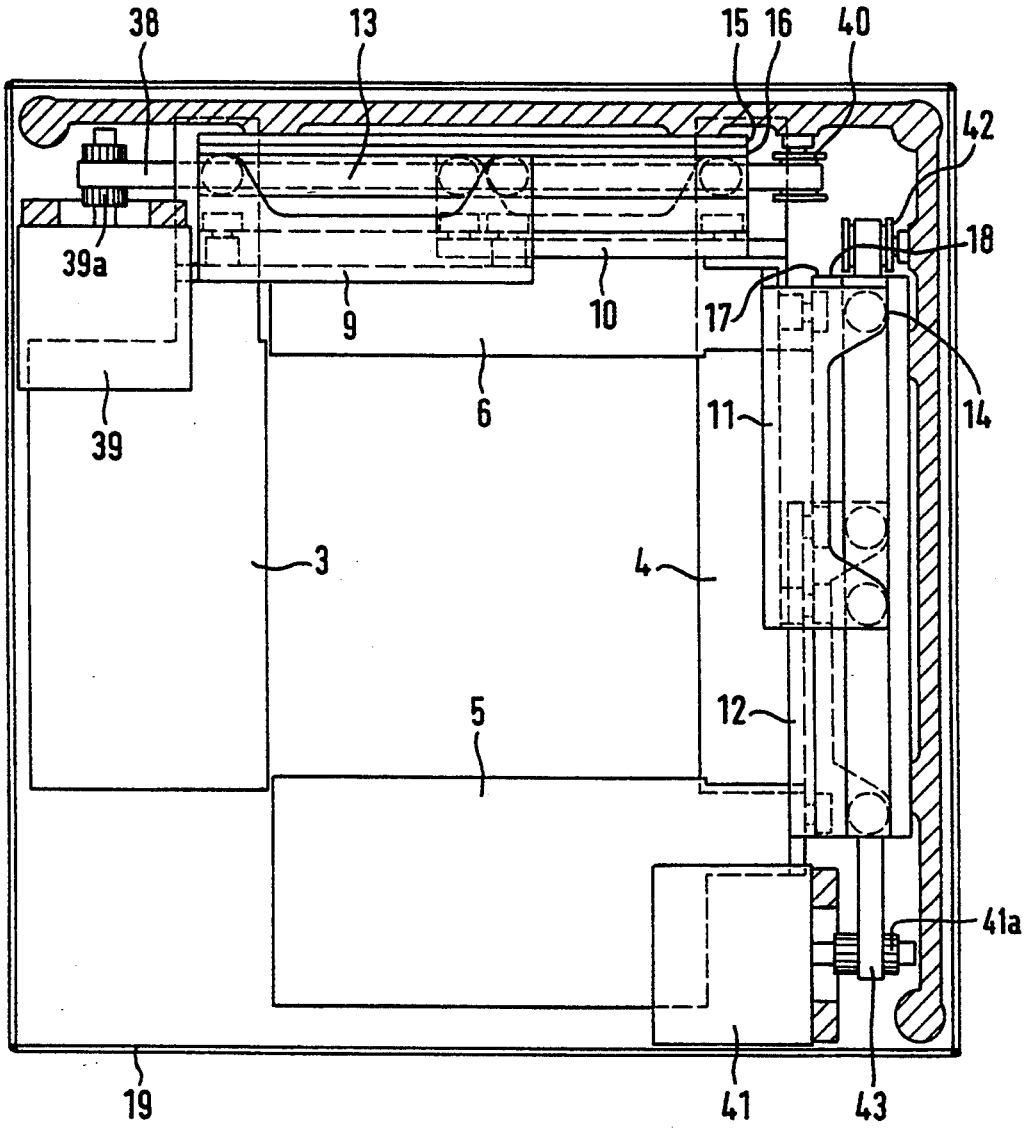
FIG. 2 is a plan view with portions broken away for purposes of illustration of the primary radiation diaphragm of FIG. 1.

The principles of the present invention are particularly useful when incorporated in a primary radiation diaphragm illustrated in FIGS. 1 and 2 for a ray beam 2 emitted by a radiation transmitter or emitter 1. For gating the ray beam 2, the primary radiation diaphragm comprises at least one diaphragm plate, but preferably four diaphragm plates, 3, 4, 5 and 6, wherein two of the plates 3 and 4 form a diaphragm plate pair that are arranged in a plane 8 (FIG. 1) and the plates 5 and 6 form a second pair and are arranged in a second plane 7, with the planes 7 and 8 extending parallel to one another and the pairs being offset 90° relative to one another and oppositely adjustable relative to one another.

A single mount 9 is provided for the plate 3, a the single mount 10 is provided for the plate 4, a single mount 11 is proved for the plate 5 and a single mount 12 is provided for the plate 6. The mounts 9 and 10 are engaged in a first guideway 13, while the mounts 11 and 12 are engaged in a second guideway 14. As illustrated, the first and second diaphragm plates 3 and 4 are adjusted along the first guideway 13, which proceeds in the plane of the drawing of FIG. 1, while the third and fourth diaphragm plates 5 and 6 are adjusted along a second guideway 14 that proceeds perpendicularly relative to the plane of the drawing of FIG. 1. It is advantageous when the first guideway 13 comprises a first rail 15 and a second rail 16 that are disposed on the same side of the housing 19 of the primary radiation diaphragm and when the second guideway 14 is composed of a first rail 17 and a second rail 18 that are seated on the same side of the housing 19, but extend at right angles to the side having the guideway 13. When the mounts 9, 10, 11 and 12 of the diaphragm plates 3–6 are respectively connected on the first and second guide rails with the mount 9 having a part 20 which engages both the rails 15 and 16, the mount 10 having a part 21 which engages both the rails 15 and 16, while the mount 11 has a part 22 engaging both the rails 17 and 18 and the mount 12 having a part 23 engaging portions of the rails 17 and 18.

The bearing support of the diaphragm plates 3 and 4 by the mounts 9 and 10 on the rails 15 and 16 or the bearing supports for the diaphragm plates 5 and 6 by the mounts 11 and 12 on the rails 17 and 18 are set forth in the exemplary embodiment with reference to the third and fourth diaphragm plates 5 and 6, whose mounts 11 and 12, respectively, as well as those of the first and second rails 17 and 18, are illustrated in FIG. 1. It is shown that every guide rail 17 has a first channel 24, a second channel 25 and a third channel 26, while the guide rail 18 has a first channel 27, a second channel 28 and a third channel 29, with these first, second and third channels being adjacent to one another, wherein the guide part, such as 22 of the mount 11 of the third diaphragm plate 5, will have a pair of spaced apart rollers 30 that are received in the first guide channel 24, a single roller 31 received in the guide channel 27 of the second guide rail which lies parallel to the rollers 30 and in the same plane. Also, the mount 22 will have a pair of spaced apart rollers 32 received in the second channel 25 of the first guide rail 17. Analogous to this, the guide part 23 for the mount 12 of the fourth diaphragm plate 6 has a single roller 33 engaged in the third channel 26 of the first guide rail 17, a pair of rollers 34 disposed in the third channel 29 of the second guide rail 18 and also a pair of roller 35 in the second guide channel 28 of the second guide rail 18. This arrangement allows each of the plates, such as 5 and 6, to be held in parallel to each other in the same plane.

The oppositely-directed adjustment of the first and second plates 3 and 4 or the third and fourth plates 5 and 6 is set forth in greater detail in FIG. 1, which shows the arrangement for moving the first plates 3 and 4. However, the movement of the third and fourth plates is the same but at right angles. For oppositely-directed adjustment of the first and second diaphragm plates 3 and 4, the mount 9 of the first diaphragm plate 3 is connected to an upper part or run 38*a* of a toothed belt 38 by a connector, such as a clamp part 36, and the mount 10 of the second diaphragm plate 4 is connected to a lower part or run 38*b* of the toothed belt 38 by a connector part 37. The two runs 38*a* and 38*b* of the belt are aligned parallel to the planes 7 and 8 and extends between an idler roll 40 and a toothed pinion 39*a* (FIG. 2) on a shaft of a motor 39. Thus, dependent on the direction of rotation of the shaft of the motor 39, the plates 3 and 4 are either adjusted toward one another or away from one another.

As illustrated in FIG. 2, a motor 41 with a pinion 41*a*, an idler 42 and a toothed belt 43 operate in the same way for moving or adjusting the third and fourth diaphragm plates 5 and 6 either together or oppositely away from each other.

Within the framework of the invention, each mount 9, 10, 11 and 12 of the diaphragm plates 3, 4, 5 and 6 can also be mounted on the respective guide parts 21–23 at only a single guide rail when the parts 21–23 and the guide rails 15, 16, 17 are executed so that the diaphragm plates are guided in a defined fashion and are, thus, adjustable parallel to the plane.

Of course, the channels of the guide rails can also be executed as webs with corresponding grooves or channels engaging therein for the guidance of the diaphragm plates.

Although various minor modifications may be suggested by those versed in the art, it should be understood that I wish to embody within the scope of the patent granted hereon all such modifications as reasonably and properly come within the scope of my contribution to the art.

I claim:

1. In a primary radiation diaphragm for a radiation apparatus comprising a housing with at least one diaphragm plate adjustable in a plane perpendicular relative to a central ray of a radiation emitter, the improvements comprising a single mount being provided for the diaphragm plate, said single mount supporting the diaphragm plate at one side to be in said plane and being adjustable along a guideway so that the plate is free of any mount on a side opposite the one side.

2. In a primary radiation diaphragm according to claim 1, which has two diaphragm plates being arranged parallel to one another in the plane, and means for moving the plates oppositely adjustable to one another.

3. In a primary radiation diaphragm according to claim 2, which includes a second pair of diaphragm plates being provided in a plane parallel to the first pair of diaphragm plates, said second pair being mounted for movement in a direction offset by 90° relative to the direction of movement of the first pair and means for oppositely adjusting the second pair relative to one another.

4. In a primary radiation diaphragm according to claim 2, wherein the guideway includes first and second guide rails being mounted on the same side of the housing of the primary radiation diaphragm, each mount of each of the pair of diaphragm plates having guide parts engaging the first and second guide rails.

5. In a primary radiation diaphragm according to claim 2, which includes a second pair of diaphragm plates being provided in a second plane extending parallel to the plane of the first pair of diaphragm plates, said second pair of diaphragm plates each having a single mount, means for moving the second pair of diaphragm plates in a direction extending perpendicular to the direction of movement of the first pair and opposite relative to one another, a first set of first and second guide rails being disposed on one wall of the housing, a second set of first and second guide rails disposed on a second wall extending at right angles to the first set, each of the mounts of the first pair of diaphragm plates having guide parts engaging the first and second guide rails of the first set and each of the mounts of the second pair of diaphragm plates having guide parts engaging the first and second guide rails of the second set.

6. In a primary radiation diaphragm according to claim 1, wherein the guideway includes a first and second guide rail being mounted on a single side of the housing of the primary radiation diaphragm, the single mount of the diaphragm plate engaging said first and second rails with guide parts and being movable therealong.

7. In a primary radiation diaphragm for a radiation apparatus comprising a housing with at least one pair of diaphragm plates adjustable in a plane perpendicular relative to a central ray of a radiation emitter, the improvements comprising means for mounting said pair of diaphragm plates comprising each plate being supported for movement in the plane by a single mount engaging only a first side of the plate, said mount being adjustable along a guideway mounted on one wall of the housing so that the plate is free of a second mount on a side opposite said first side.

8. In a primary radiation diaphragm according to claim 7, wherein the guideway includes first and second guide rails, each mount of each diaphragm plate having guide parts engaging the first and second guide rails.

9. In a primary radiation diaphragm according to claim 7, which includes a second pair of diaphragm plates being provided in a second plane extending parallel to the plane of the first pair of diaphragm plates, said second pair of diaphragm plates each having a single mount, means for moving the second pair of diaphragm plates in a direction extending perpendicular to the direction of movement of the first pair and opposite relative to one another, said guideway including a first set of first and second guide rails being disposed on said one wall of the housing, a second guideway formed by a second set of first and second guide rails disposed on a second wall extending at right angles to the first set, each of the mounts of the first pair of diaphragm plates having guide parts engaging the first and second guide rails of the first set and each of the mounts of the second pair of diaphragm plates having guide parts engaging the first and second guide rails of the second set.

* * * * *